US010036534B2

(12) United States Patent
Morello et al.

(10) Patent No.: US 10,036,534 B2
(45) Date of Patent: Jul. 31, 2018

(54) HIGH BAY LIGHT FIXTURE

(71) Applicant: ABL IP Holding LLC, Conyers, GA (US)

(72) Inventors: Jared Timothy Morello, Columbus, OH (US); Yinan Wu, Atlanta, GA (US); Justin Thomas Moon, Conyers, GA (US); Bruce Allen Moore, Buford, GA (US); Jamie Jo Pearson, Covington, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 14/677,797

(22) Filed: Apr. 2, 2015

(65) Prior Publication Data

US 2016/0290603 A1 Oct. 6, 2016

(51) Int. Cl.
*F21V 1/00* (2006.01)
*F21V 13/02* (2006.01)
(Continued)

(52) U.S. Cl.
CPC ..... *F21V 13/02* (2013.01); *F21S 8/04* (2013.01); *F21V 23/02* (2013.01); *F21V 29/78* (2015.01);
(Continued)

(58) Field of Classification Search
CPC ..... F21V 13/02; F21V 29/10; F21V 29/74; F21V 29/78; F21V 17/08; F21V 21/008; F21V 21/02; F21V 21/10; F21V 23/02; F21S 8/04; F21W 2131/40; F21Y 2105/003
(Continued)

(56) References Cited

U.S. PATENT DOCUMENTS

D592,786 S 5/2009 Bisberg et al.
8,899,783 B1 * 12/2014 Simon ..... G02B 6/0011 362/235
(Continued)

FOREIGN PATENT DOCUMENTS

EP 2806209 11/2014

OTHER PUBLICATIONS

Office Action Canadian Application No. CA 2,924,475, dated Feb. 20, 2017, 6 pages.
CA 2,924,475, "Office Action" Feb. 28, 2018, 5 pages.

*Primary Examiner* — Elmito Breval
*Assistant Examiner* — Omar Rojas Cadima
(74) *Attorney, Agent, or Firm* — Kilpatrick Townsend & Stockton LLP

(57) ABSTRACT

A high bay light fixture includes a substantially disc-shaped base, disposed horizontally so as to define an upper surface, a lower surface and a vertical axis. Groups of first light emitting diodes (LEDs) couple with the lower surface of the base. The LEDs within each group of first LEDs are arranged along one or more arcs of substantially constant radius relative to the vertical axis. At least one lower optic couples with the lower surface of the base such that the lower surface and the lower optic enclose the groups of the first LEDs. A plurality of second LEDs couples with the upper surface of the base. Upper optics couple with the upper surface of the base, such that the upper surface of the base and each of the upper optics enclose at least one of the second LEDs.

20 Claims, 10 Drawing Sheets

(51) Int. Cl.

| | |
|---|---|
| ***F21V 23/02*** | (2006.01) |
| ***F21V 29/78*** | (2015.01) |
| ***F21S 8/04*** | (2006.01) |
| *F21Y 105/00* | (2016.01) |
| *F21W 131/40* | (2006.01) |

(52) U.S. Cl.
CPC .... *F21W 2131/40* (2013.01); *F21Y 2105/003* (2013.01)

(58) Field of Classification Search
USPC ..... 362/235, 236, 238, 249.02, 249.16, 294, 362/311.01
See application file for complete search history.

(56) References Cited

U.S. PATENT DOCUMENTS 8,911,106 B2 * 12/2014 Sato ..... F21S 8/061 362/241
9,140,421 B2 * 9/2015 Yeh ..... F21S 8/04
9,360,165 B2 * 6/2016 Jin ..... F21K 9/135
2006/0209541 A1 9/2006 Peck
2009/0103296 A1 * 4/2009 Harbers ..... F21V 7/22 362/234
2010/0124058 A1 * 5/2010 Miller ..... F21S 8/038 362/249.02
2010/0282446 A1 * 11/2010 Yamamoto ..... F21S 8/02 165/109.1
2011/0084593 A1 4/2011 Chang et al.
2012/0113640 A1 * 5/2012 Markle ..... F21S 8/04 362/249.02
2013/0063937 A1 * 3/2013 Ahn ..... F21V 29/2293 362/235
2014/0098542 A1 4/2014 Zimmer et al.
2014/0153252 A1 * 6/2014 Shida ..... F21V 17/101 362/294
2014/0313765 A1 10/2014 Nelson et al.
2016/0047538 A1 * 2/2016 Peck ..... F21V 23/009 362/249.02

* cited by examiner

FIG. 6A
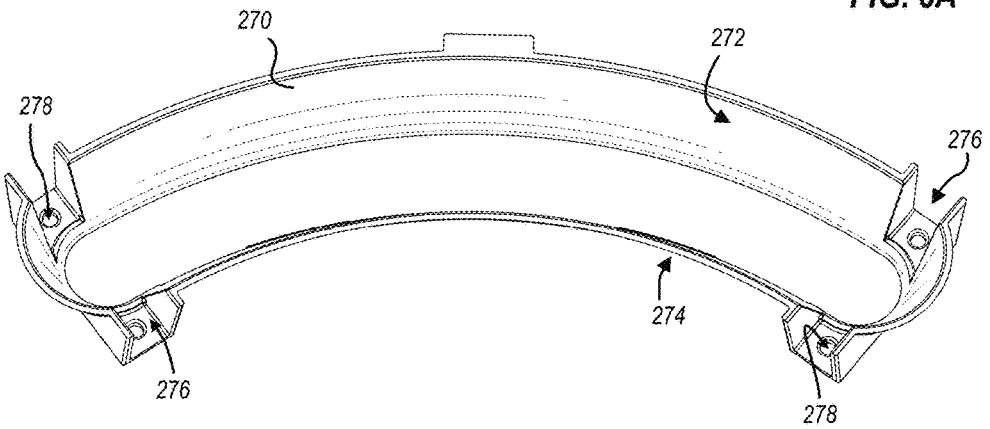
FIG. 6B
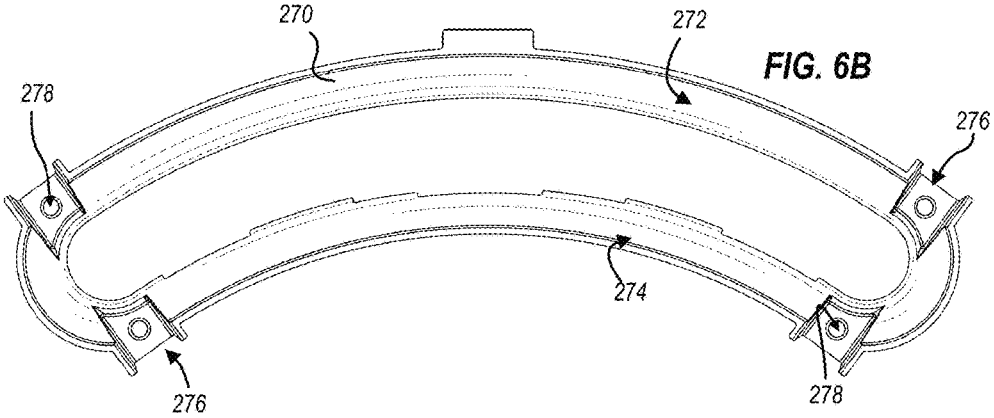
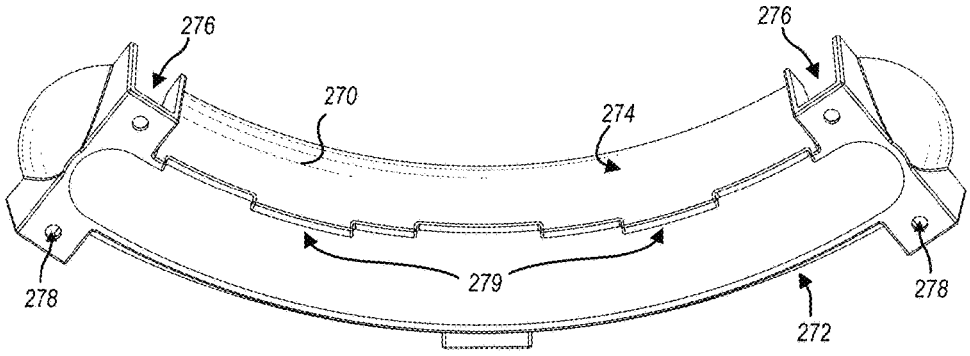
FIG. 6C

HIGH BAY LIGHT FIXTURE

BACKGROUND

Large interior spaces such as "big box" stores often use so-called "high bay" light fixtures as an economical way to provide light throughout the spaces. Present day light fixtures are often based on high intensity discharge (HID) lamps, and may include refractors and/or reflectors for diverting most of the emitted light downward to where people such as shoppers typically are. Light-emitting diodes (LEDs) offer improved energy efficiency in terms of lumens per watt of electrical energy consumed. However, LEDs are temperature sensitive, tend to concentrate light in small emission areas such that they can become painful to look at, and tend to emit light in a Lambertian distribution that is often not ideal for lighting large spaces.

SUMMARY

In an embodiment, a high bay light fixture includes a substantially disc-shaped base that is disposed horizontally so as to define an upper surface, a lower surface and a vertical axis extending through a centroid of the base. A plurality of groups of first light emitting diodes (LEDs) couple with the lower surface of the base. The LEDs within each group of first LEDs are arranged along one or more arcs of substantially constant radius relative to the vertical axis. At least one lower optic couples with the lower surface of the base such that the lower surface of the base and the at least one lower optic enclose the groups of the first LEDs. A plurality of second LEDs couples with the upper surface of the base. A plurality of upper optics couples with the upper surface of the base, such that the upper surface of the base and each of the upper optics enclose at least one of the second LEDs.

BRIEF DESCRIPTION OF THE DRAWINGS

The present disclosure is described in conjunction with the appended figures:

FIGS. 6A, 6B and 6C are views illustrating one of the reflectors shown in FIG. 4, in accord with an embodiment.

DETAILED DESCRIPTION

Figure 1A:
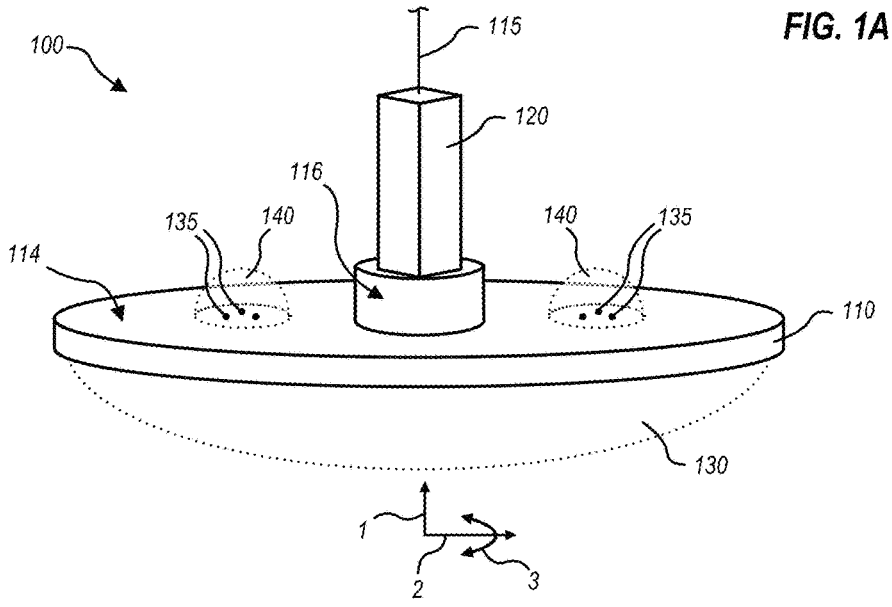
FIGS. 1A and 1B schematically illustrate major features of an LED based high bay light fixture, in accord with an embodiment.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. In instances where multiple instances of an item are shown, only some of the instances may be labeled, for clarity of illustration.

The present disclosure describes LED based, high bay light fixtures. Embodiments herein achieve high energy efficiency through the use of LEDs as light emitters, and by tailoring light distributions therefrom to provide useful illumination for "big box" type interior spaces. Certain embodiments herein also provide full electrical, mechanical and luminous "drop-in" replaceability for existing HID based high bay fixtures.

One specific type of "big box" store is the warehouse store, in portions of which relatively high racks or shelves are erected, while the remainder of the store is free of high shelves. The ceiling of the store is relatively high and of a constant height. Light fixtures deployed where high shelves are erected should provide even lighting for the shelves and spaces between them. Yet the same fixtures, when deployed in open areas, should provide uniform lighting at and near the floor level throughout the space, therefore light distributions of adjacent fixtures should merge at least to some degree, instead of projecting very bright spots immediately below each fixture with dim areas between fixtures. High angle light (that is, light emitted in the range of 60 to 90 degrees, with nadir being defined as zero degrees) is undesirable as it generates glare for distant viewers. At least some light should project upward, to provide a lighted ceiling, and avoiding what is called the "cave" effect (a dark ceiling with bright lights mounted high). However, light emitted upward at low angles above 90 degrees does little to mitigate the "cave" effect, so minimizing light emissions in the range of about 90 to 120 degrees helps efficiency. In a plan view, circularly symmetric distributions are generally desirable.

Thermal management can also be an issue for LED based lighting. Not only do LEDs themselves generate heat that must be removed, but electronics that transform input power, such as typical 120V alternating current (AC) line voltage, to low voltage (e.g., <=60V) direct current (DC) power for driving LEDSs, also generate heat. Finding a place for the electronics where the heat generated will not be transferred to the LEDs, and where the electronics will not physically block desired light emissions, is not trivial.

Figure 1B:
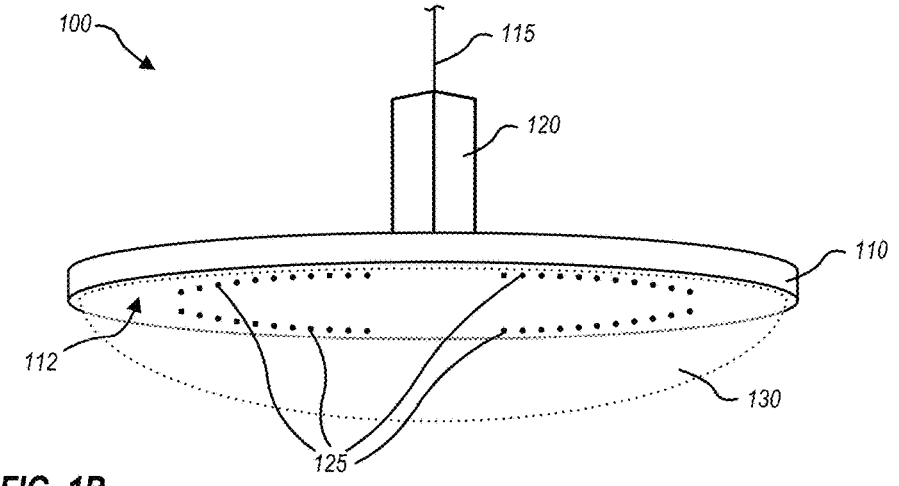

FIGS. 1A and 1B schematically illustrate major features of an LED based high bay light fixture 100 that meets the objectives generally described above. FIG. 1A provides a schematic isometric view that looks down from slightly above a disc-shaped base 110 of light fixture 100, while FIG. 1B provides a schematic isometric view that looks up from slightly below base 110. For reference purposes, disc-shaped base 110 can be thought of as defining a vertical axis 1 that passes through a centroid of base 110, and with respect to vertical axis 1, a radial direction 2 and an azimuthal direction 3 can be defined.

Light fixture 100 is suspended from a ceiling by a cable 115 that also supports a power line (e.g., a 120V AC line) for light fixture 100. Cable 115 is received into and provides mechanical support to an electronics box 120, which extends in the direction of vertical axis 1. Electronics box 120 houses electronics for converting external power to the low voltage DC power used by LEDs 125, 135, discussed below. Electronics box 120 couples to an upper surface 114 of base 110, optionally through an upward protrusion 116 of upper surface 114, as shown in FIG. 1A. Upward protrusion 116 helps to thermally decouple electronics box 120 from base 110 and thus from LEDs 125, 135, coupled therewith. In certain embodiments, upward protrusion 116 extends above a level of upper optics 140 described below, but in other embodiments upward protrusion 116 may not extend above a level of upper optics 140, or upward protrusion 116 may not be present at all. Upward protrusion 116 is shown as cylindrical in FIG. 1A, but may be of any shape. Similarly, electronics box 120 may be of any shape; a rectilinear shape is shown by way of example only in FIGS. 1A and 1B. Electronics box 120 may provide access to parts therein, for initial assembly and later installation and/or maintenance purposes. Electronics box 120 may include external features such as fins to improve heat dissipation therefrom.

A majority of light produced by light fixture 100 is emitted by first LEDs 125 coupled with a lower surface 112 of base 110 (only a few examples of first LEDs 125 are labeled in FIG. 1B, for clarity of illustration). LEDs 125 are arranged in arcs, each arc being located at a substantially constant radius from vertical axis 1 (that is, at a constant value of direction 2 from vertical axis 1, as shown). Also, the arcs are arranged symmetrically about vertical axis 1, as discussed further below. Arranging LEDs 125 in arcs arranged symmetrically about vertical axis 1 helps to preserve circular symmetry of a far field photometric distribution from light fixture 100. Also, using an arrangement of limited arcs instead of providing a single, full circle band of LEDS on bottom surface 112 provides certain opportunities for cost reduction, as discussed further below; however, a continuous circle of LEDs is also within the scope of embodiments herein. First LEDs 120 are enclosed by lower surface 112 and a lower optic 130, as shown. Lower optic 130 helps to shape light from first LEDs 120 to achieve desired far field photometric distributions, as well as to diffuse and/or break up light from individual LEDs into a plurality of point sources, as seen as a distance, to reduce possibly harsh, bright direct views of the individual LEDs. Other, optional features may be present in the vicinity of first LEDs 125 to refract and/or reflect light therefrom to form a desired photometric distribution, as discussed below.

A number of second LEDs 135 that emit light upwardly are coupled with an upper surface 114 of disc-shaped base 110 (only a few examples of second LEDs 135 are labeled in FIG. 1A, for clarity of illustration). Second LEDs 135 are enclosed by upper surface 114 and upper optics 140, as shown. The number and placement of second LEDs 135 and upper optics 140 may vary; although FIG. 1A shows two groups of second LEDs 135 and upper optics 140, other embodiments herein utilize four groups of second LEDs 135 within four corresponding upper optics 140. Also, the modes in which LEDs 125, 135 couple with lower surface 112 and upper surface 114 respectively may vary in embodiments; for example, certain embodiments utilize LEDs 125 and/or 135 coupled directly with surfaces 112 and/or 114 while other embodiments couple LEDs 125 and/or 135 with printed circuit boards (PCBs) that then couple with surfaces 112 and/or 114. Furthermore, LEDs 125 and/or 135 may be provided in various forms, including as unpackaged LED chips (e.g., via chip-on-board technology), minimally packaged chips (e.g., assembled from tape and reel), packaged LEDs and/or multiple LED chips in packages. When PCBs are used, a single PCB may serve all LEDs on a given side of base 110, or multiple PCBs may be used.

Light fixture 100 may, for example, achieve a circularly symmetric, far field photometric distribution substantially identical to that of high intensity discharge (HID) based light fixtures. Alternatively, a photometric distribution provided by light fixture 100 may be identical to that of an HID based light fixture below the plane of disc-shaped base 110, while the distribution above the plane of base 110 may be different, and adjustable by increasing or decreasing the number and placement of LEDs 135 on upper surface 114.

It is emphasized here that FIGS. 1A and 1B are provided for illustrative purposes and may not reflect an actual appearance of light fixture 100. Many variations are possible in embodiments. One particular embodiment is now described in connection with FIGS. 2 through 9; the detailed description below provides additional information that one skilled in the art can utilize to generate additional embodiments and alternative constructions for the high bay light fixtures described.

Figure 2:
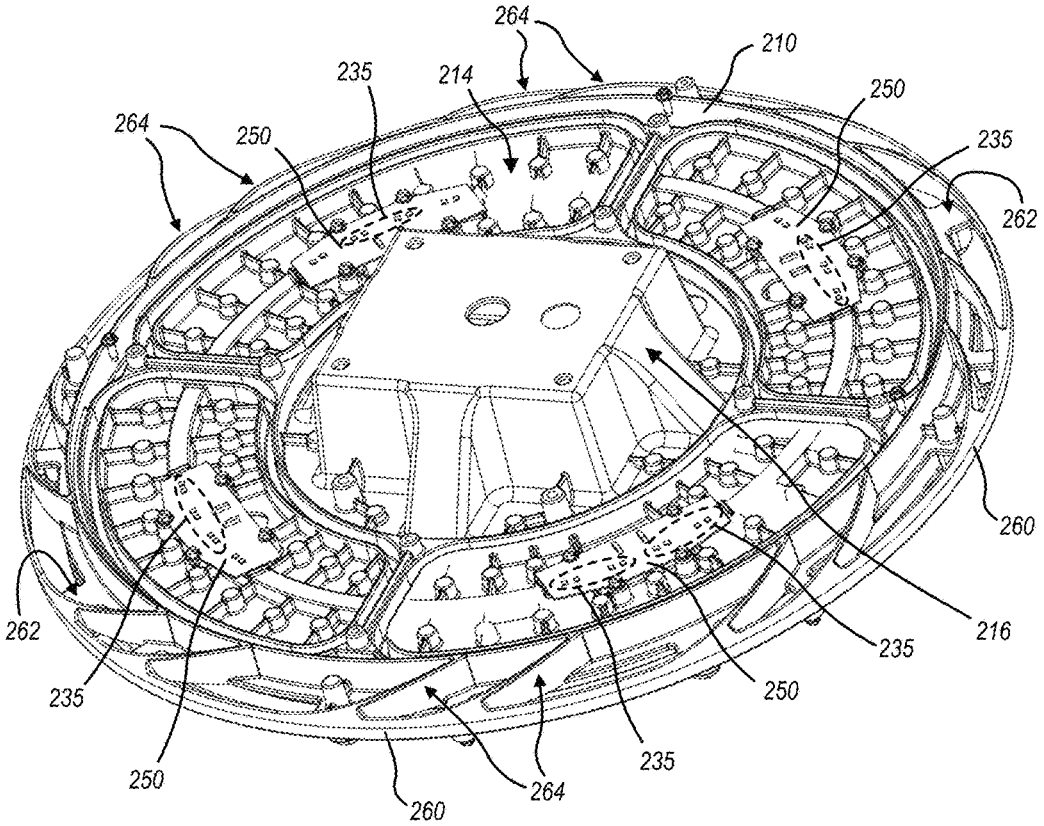
FIG. 2 is an isometric view illustrating a portion of an LED based high bay light fixture, in accord with an embodiment.

FIG. 2 is an isometric view illustrating a portion of an LED based high bay light fixture, without optics and without an associated electronics box, for clarity of illustration. In FIG. 2, a substantially disc-shaped base 210 has an upper surface 214. A plurality of PCBs 250 couple with upper surface 214; each PCB 250 includes one or more LEDs 235 (though as noted above, LEDs 235 couple directly with base 210 in other embodiments). Not all LEDs 235 are labeled as such in FIG. 2, for clarity of illustration. LEDs 235 are arranged symmetrically about a vertical axis that passes through a centroid of base 210 to provide symmetric light emission from fixture 200; however, PCBs 250 are relatively small to minimize cost of manufacturing each PCB. Disc-shaped base 210 includes an upward protrusion 216 to which an electronics box attaches (see FIGS. 3-5 and 7). Disc-shaped base 210 also features an outer rim 260 supported by lateral arms 262 and spiral arms 264. As discussed below, spiral arms 264 promote heat dissipation by introducing rotation in air that passes by base 210 and spiral arms 264; the rotation thus generated increases heat transfer into the air from surfaces of the light fixture.

Figure 3:
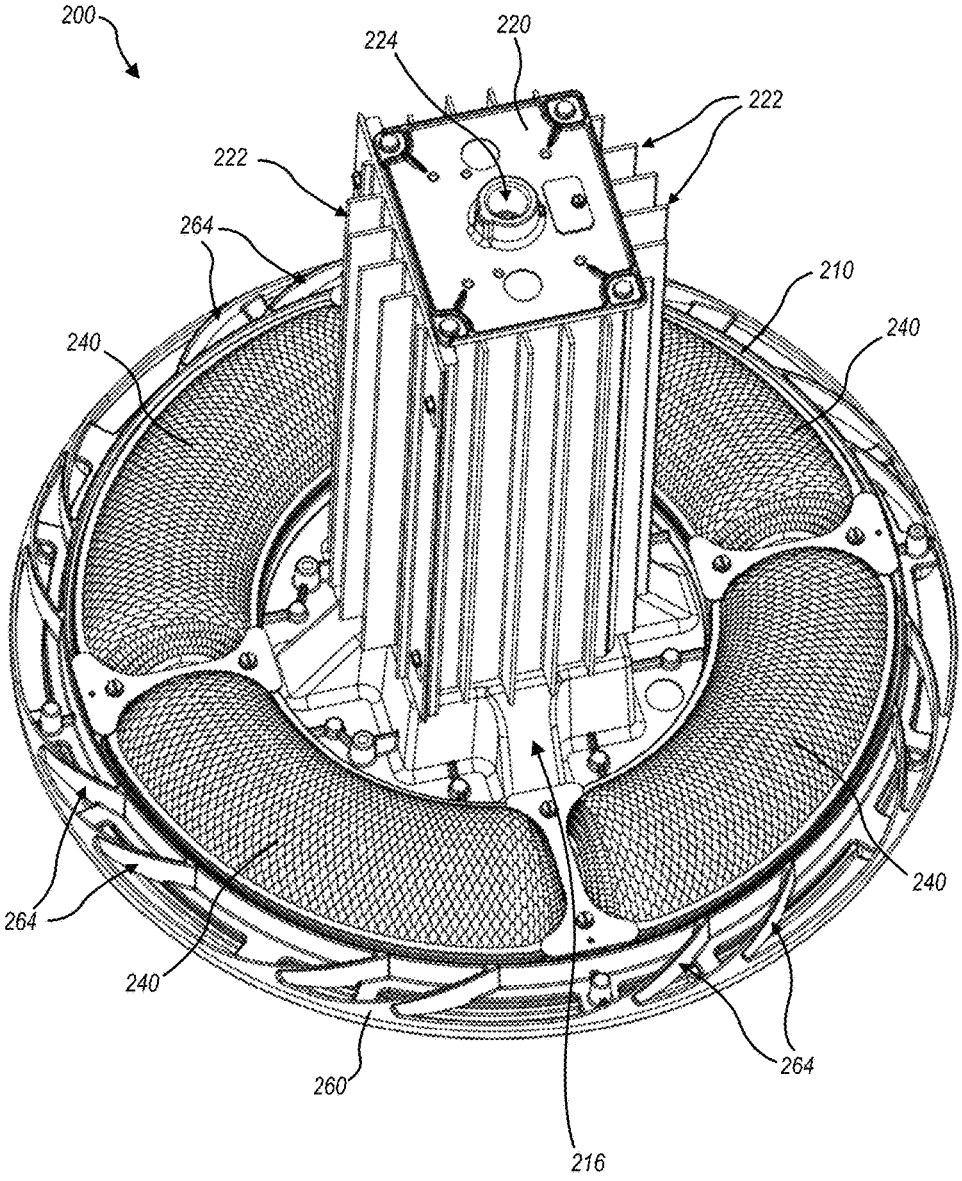
FIG. 3 is an isometric view illustrating a LED based high bay light fixture, with optics and an electronics box coupled with the portion illustrated in FIG. 2, in accord with an embodiment.
Figure 4:
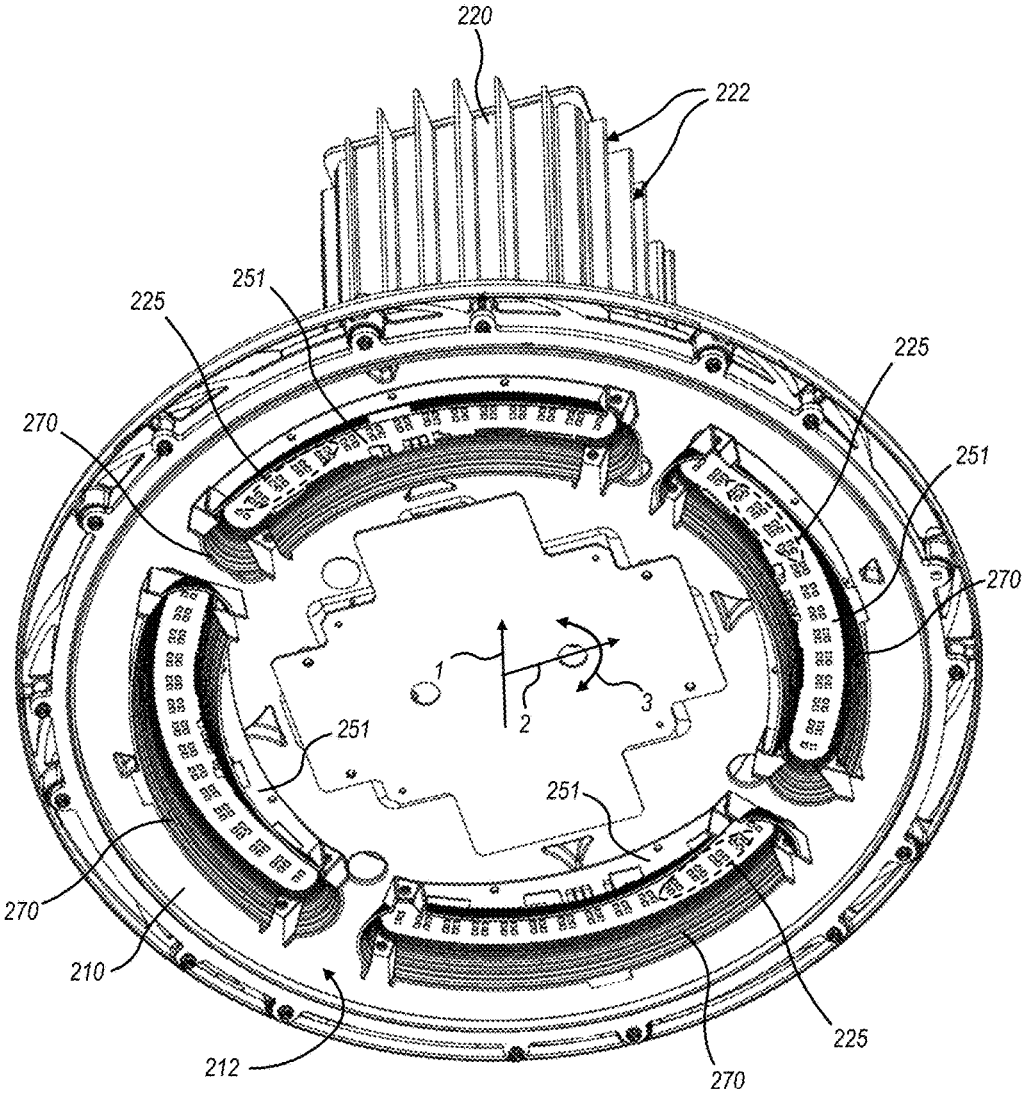
FIG. 4 is an isometric view illustrating a portion of the LED based high bay light fixture of FIG. 3, in accord with an embodiment.

FIG. 3 is an isometric view illustrating a LED based high bay light fixture 200 that includes upper optics 240 and an electronics box 220 coupled with disc-shaped base 210 (see FIG. 2). FIG. 3 illustrates high bay light fixture 200 from a vantage point above disc-shaped base 210. Each optic 240 couples with base 210, enclosing one of the PCBs 250 and LEDs 235 thereon between the optic and the base to protect LEDs 235 and to insulate electronics, wiring etc. of each PCB 250 for safety and reliability. Electronics box 220 couples with upward protrusion 216; coupling electronics box 220 with upward protrusion 216 assists in heat dissipation, as compared with coupling electronics box 220 with a similar base without protrusion 216. That is, heat generated by electronics box 220 will generate an updraft in adjacent air and will thus transmit the dissipated heat upwardly, so the vertical spacing provided by protrusion 216 helps minimize heat transfer downward to disc-shaped base 210 and thus to LEDs 235 (FIG. 2) and/or LEDs 225 (FIG. 4). The same updraft draws air through airflow apertures formed between spiral arms 264, which introduce rotation into the updrafted air. The rotating updraft improves contact between the updrafted air and heat fins 222 of electronics box 220, improving heat transfer from electronics box 220 to the air. In the embodiment shown in FIG. 3, electronics box 220 forms a hole 224 in a top surface thereof, to receive incoming power and/or mechanical support features (e.g., a cable from which light fixture 200 is suspended). However, other modalities of providing power to, and supporting or suspending, light fixture 200 are contemplated.

FIG. 4 is an isometric view illustrating a portion of LED based high bay light fixture 200 without a lower optic, from a vantage point beneath disc-shaped base 210. Arcs of LEDs 225 couple with a bottom surface 212 of base 210 through PCBs 251. The illustrated embodiment provides double-row arcs of LEDs 225, but more or fewer arcs of LEDs 225 may be present in other embodiments; it is also possible to provide LEDs 225 in groups that are not precisely aligned rows as shown in FIG. 4, but are generally arc shaped groups such that once diffused by an outer optic (see FIG. 5), a light distribution pattern therefrom is substantially symmetric. The illustrated embodiment also includes reflectors 270 that narrow a photometric distribution of light fixture 200 by deflecting high angle rays (e.g., rays that emerge nearly horizontally from LEDs 225) downward. In the embodiment shown in FIG. 4, reflectors 270 surround LEDs 225 azimuthally; in other embodiments, reflectors only reflect high angle rays that are originally directed from the LEDs toward the vertical axis outwardly, to widen a photometric distribution of an associated light fixture.

In the embodiment shown in FIG. 4, LEDs 225 are provided in four groups, each group being laid out as a double arc. Each double arc is associated with a single reflector 270 and single PCB 251 that subtends an angle in azimuthal direction 3 about vertical axis 1 of just under 90 degrees, to allow for placement of adjacent PCBs 251 and reflectors 270; arcs that subtend angles of about 70 degrees are typical. Each PCB 251 and reflector 270 is azimuthally offset by 90 degrees from adjacent ones of PCBs 251 and reflectors 270. Light fixture 200 is advantageously manufactured with LEDs arranged in arcs for symmetry of the resulting photometric distribution, and that the arcs be limited, such as arcs that form quarter circles, one third circles and the like. Small-arc PCBs and reflectors are easily manufactured, stored and shipped. Also, replacing a single, small-arc PCB is less costly than replacing a larger PCB when a single component is defective or damaged. As there will generally be some percentage of components (e.g., single LEDs) that are defective as received by a PCB manufacturer, replacing PCBs with individual ones of those defective components will be less costly when the PCBs are small, than when they are large. Also advantageous from a thermal dissipation standpoint, comparison of FIG. 4 with FIGS. 2 and 3 reveals that the four-fold arrangements of LEDs 225 and 235 are azimuthally offset by about forty-five degrees. That is, centroids of LEDs 225 are arranged so as to be roughly centered with respect to sides of electronics box 220 (FIG. 4) while centroids of LEDs 235 are arranged so as to be roughly centered about corners of electronics box 220 (FIGS. 2, 3). These arrangements are advantageous in that heat generated by the LEDs and transferred to disc-shaped base 210 is spread out, not concentrated by groups of LEDs on both sides of base 210 transferring heat to about the same areas.

Figure 5:
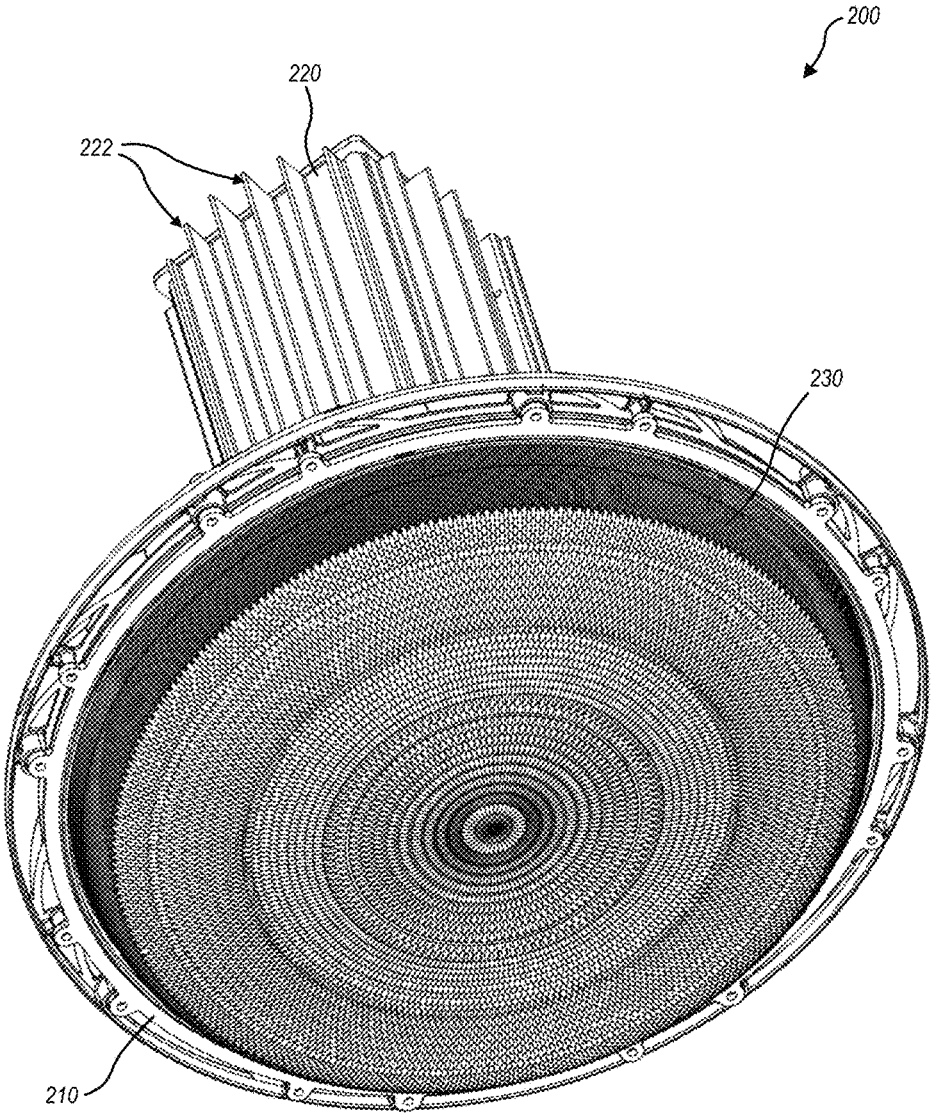
FIG. 5 is an isometric view illustrating LED based high bay light fixture 200, including a lower optic, in accord with an embodiment.

FIG. 5 is an isometric view illustrating LED based high bay light fixture 200, including a lower optic 230. FIG. 5 again illustrates light fixture 200 from a vantage point beneath disc-shaped base 210. Optic 230 couples with base 210, enclosing PCBs 251 and LEDs 225 thereon between the optic and the base to protect LEDs 225 and to insulate electronics, wiring etc. associated with each PCB 251 for safety and reliability. In an embodiment, lower optic 230 may be clear, in which case it does not substantially alter a photometric distribution produced by LEDs 225 and reflectors 270 (FIG. 4). In other embodiments, lower optic 230 is faceted or frosted so as to break up and/or blend the light produced by individual LEDs 225, for enhanced symmetry and to spread light from individual ones of the LEDs over wider areas, to make a direct view of light fixture 200 more comfortable to a viewer.

It will be apparent to one skilled in the art that light fixture 200 is a particular embodiment of light fixture 100, FIG. 1, and may achieve a far field photometric distribution substantially identical to that of high intensity discharge (HID) based light fixtures; alternatively, such photometric distribution may be identical below light fixture 200, while the photometric distribution above light fixture 200 may be adjusted (and may be different from that of HID based light fixtures) by adjusting number and placement of LEDs 235 on upper surface 214 of base 210.

FIG. 6A is a first isometric view illustrating one reflector 270, from a vantage point near the vertical axis of light fixture 200 and below disc-shaped base 210 (FIG. 4). A distal arc 272 of reflector 270 (e.g., distal from the vertical axis) is clearly shown in FIG. 6A, but a proximal arc 274 of reflector 270 is flattened in this view. Both distal arc 272 and proximal arc 274 form recesses 276 to provide manufacturing access to mounting features 278, as shown. Mounting features 278 are shown as apertures that may, for example, receive screws or other fasteners; in other embodiments mounting features 278 may be features that mate with corresponding features of PCB 251, such as tabs, prongs, flanges and the like. Numerous equivalent features and arrangements will be evident to one skilled in the art; in certain such cases, recesses 276 are not needed for access to mounting features 278.

FIG. 6B is a bottom plan view illustrating reflector 270. Both distal arc 272 and proximal arc 274 of reflector 270 are clearly shown in FIG. 6B. An upper edge of proximal arc 274 (e.g., an edge that, when assembled with light fixture 200, abuts PCB 251) features standoff features 279.

FIG. 6C is a second isometric view illustrating reflector 270, from a vantage point near the vertical axis of light fixture 200. Proximal arc 274 of reflector 270, and standoff features 279, are clearly shown in FIG. 6C, but distal arc 272 is flattened in this view.

Disc-shaped base 210 may be made from any suitable metallic or polymeric material, but in some embodiments it is formed from a thermally conductive material so as to help dissipate the heat generated by the LEDs. For example, in some embodiments the disc-shaped base 210 is formed from metal (such as aluminum or steel) to promote heat dissipation from LEDs 225, 235 and may be formed by casting. PCBs 250 and 251 are made of conventional PCB materials. Electronics box 220 is typically made of metal formed by casting or extruding, although again other materials can be utilized, or certain portions of electronics box 220 may be made of metal while other portions are made of other materials. Reflectors 270 are typically molded of plastic, particularly polycarbonate, and are metallized to provide reflective surfaces at least on distal arc 272 and proximal arc 274; other surfaces of reflectors 270 need not be reflective. Optics 230, 240 may be formed of glass or plastic (e.g., acrylic, polycarbonate, silicone, etc.), typically by molding, and may, in embodiments, couple with base 210 to form watertight seals, or may be simply held in place without sealing. For example, gaskets formed of silicone or rubber may be utilized between optics 230, 240 and disc-shaped base 210 in order to form seals therebetween. In some embodiments, optics 230, 240 are configured with optical enhancements to achieve a desired light distribution and effect from the light fixture. LEDs 225, 335 are typical packaged LEDs or LED chips. Rigorous packaging of LEDs 225, 235 is not required in all embodiments, especially when optics 230, 240 couple with base 210 so as to provide substantial protection.

Figure 7:
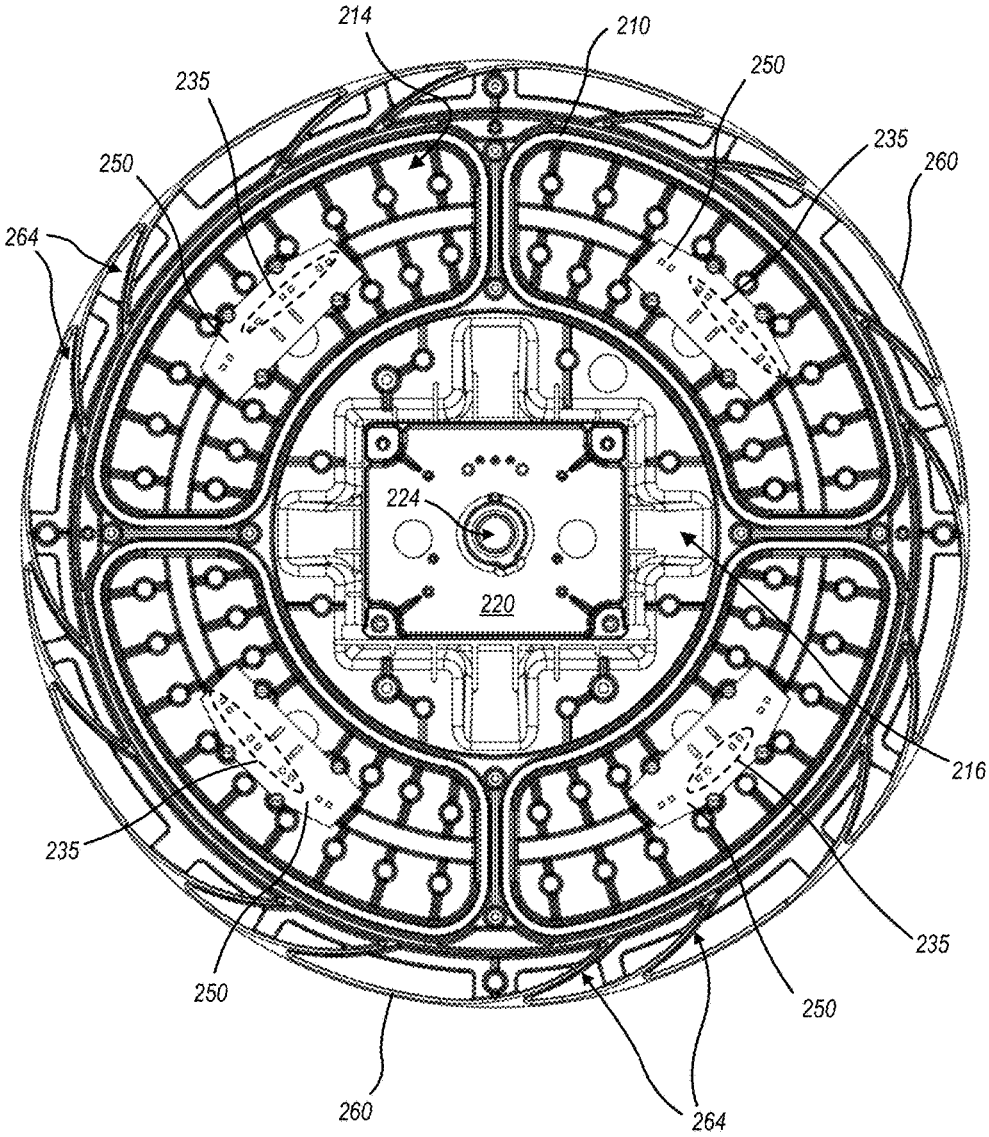
FIG. 7 is a top plan view illustrating the portion of a LED based high bay light fixture shown in FIG. 2, with an electronics box but without optics, in accord with an embodiment.

FIG. 7 is a top plan view illustrating the portion of a LED based high bay light fixture shown in FIG. 2, with electronics box 220, but without optics, to show underlying structures. Visible in FIG. 7 are disc-shaped base 210 with upward protrusion 216; electronics box 220 coupled with protrusion 216; four PCBs 250 coupled with upper surface 214 of base 210, each PCB 250 having LEDs 235 coupled thereto; and spiral arms 264 connecting outer rim 260 with base 210.

Figure 8:
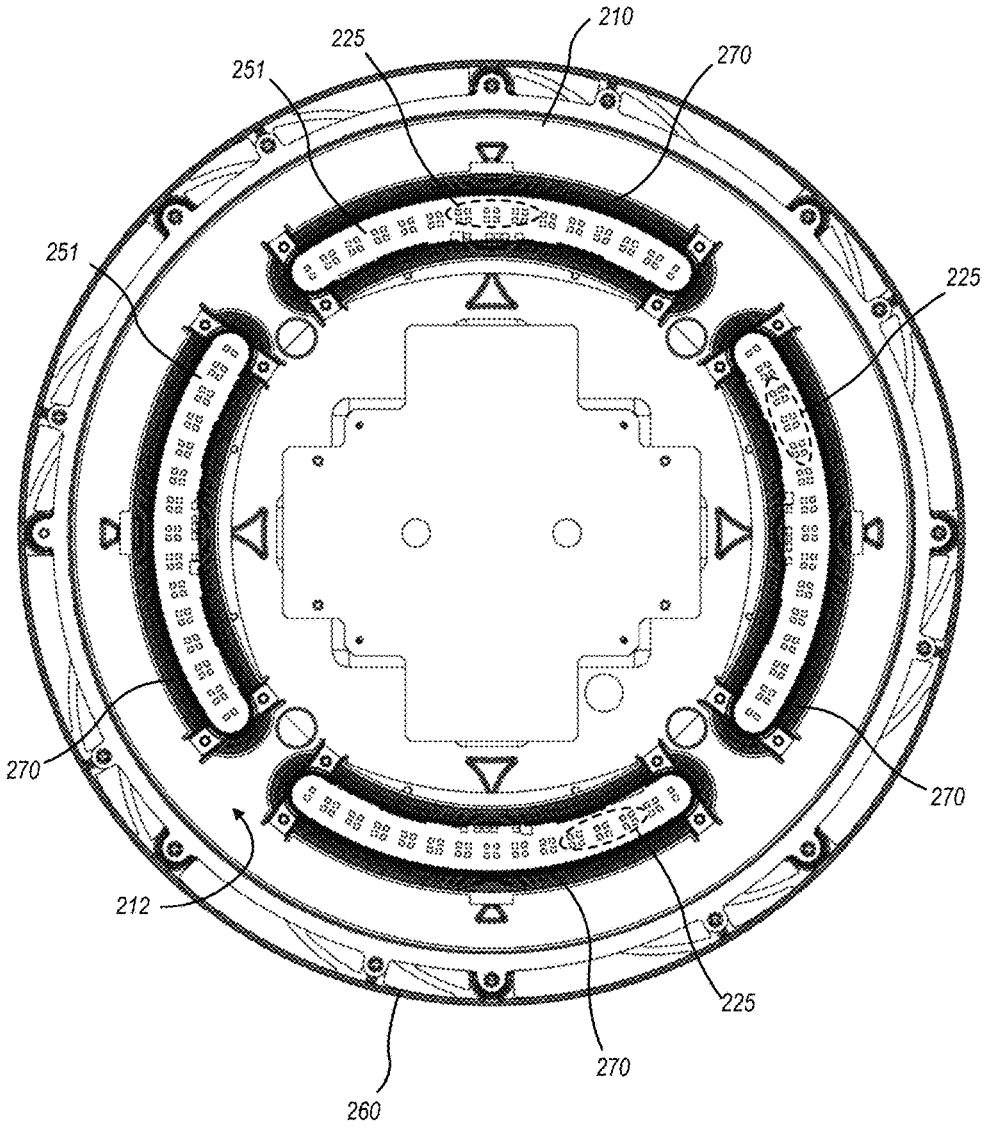
FIG. 8 is a bottom plan view illustrating the portion of a LED based high bay light fixture shown in FIG. 2, without optics, in accord with an embodiment.

FIG. 8 is a bottom plan view illustrating the portion of a LED based high bay light fixture shown in FIG. 2, without optics, to show underlying structures. Visible in FIG. 8 are disc-shaped base 210; four PCBs 251 coupled with lower surface 212 of base 210, each PCB 251 having LEDs 225 coupled thereto; and reflectors 270 coupled with PCBs 251.

Figure 9:
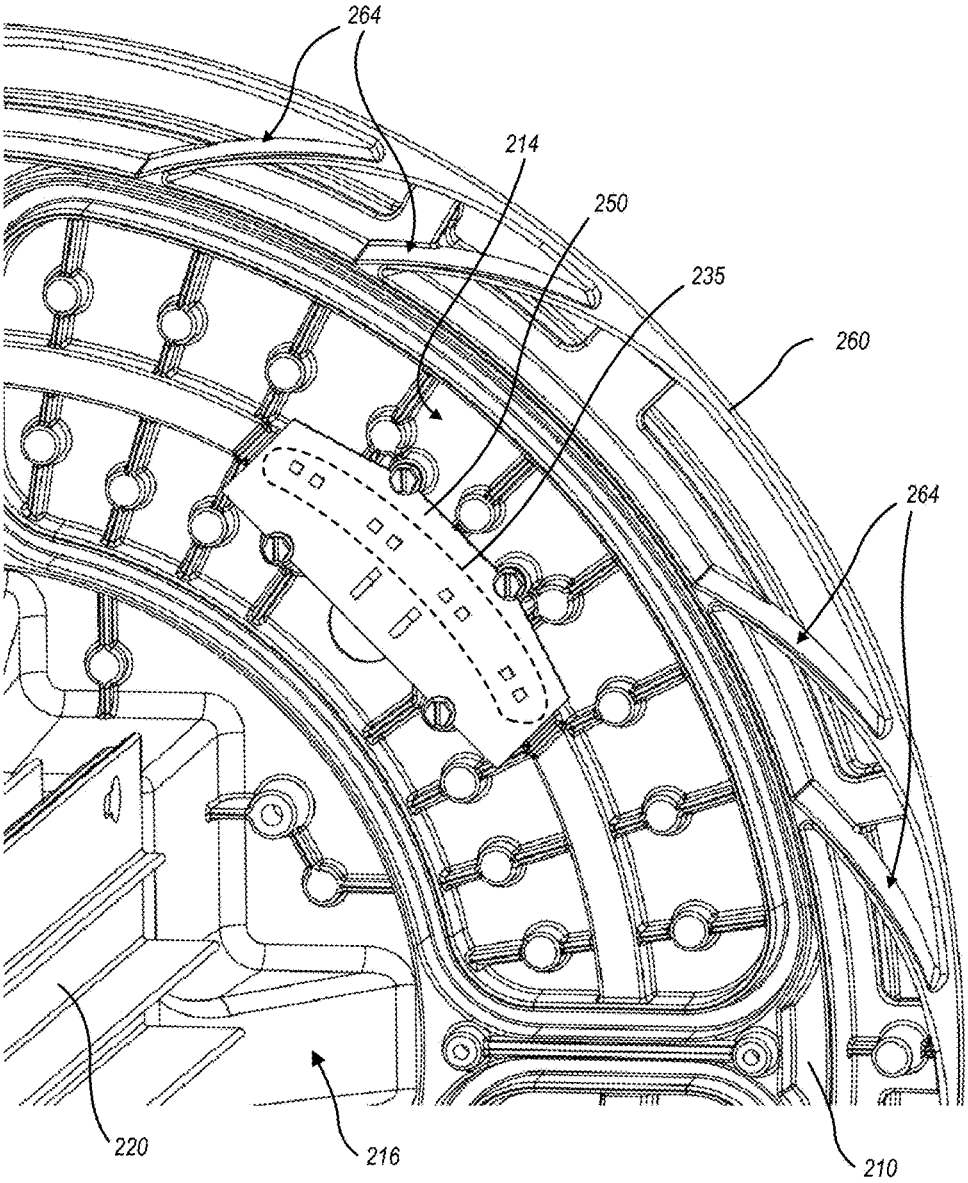
FIG. 9 is an enlarged isometric view illustrating a portion of the LED based high bay light fixture shown in FIG. 2, but without optics, in accord with an embodiment.

FIG. 9 is an enlarged isometric view illustrating a portion of the LED based high bay light fixture shown in FIG. 2, but without optics, to show certain structures in greater detail. Visible in FIG. 9 are a portion of disc-shaped base 210 with a corresponding portion of upward protrusion 216; a portion of electronics box 220 coupled with protrusion 216; one PCB 250 coupled with upper surface 214 of base 210, and having LEDs 235 coupled thereto; and spiral arms 264 connecting outer rim 260 with base 210.

Figure 10A:
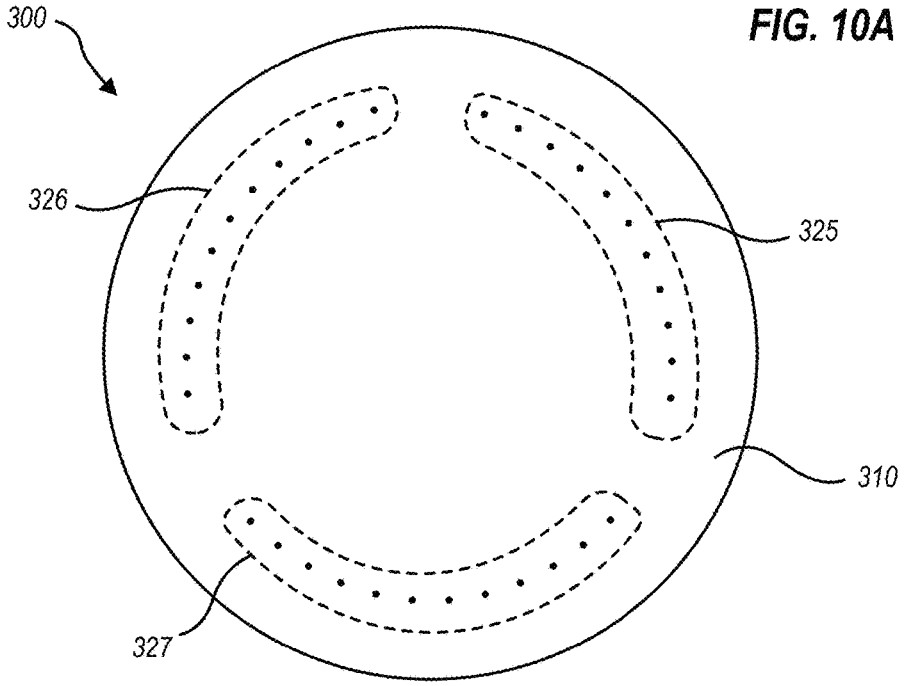
FIGS. 10A and 10B are schematic diagrams illustrating alternative layouts of LEDs for high bay light fixtures, in accord with embodiments.
Figure 10B:
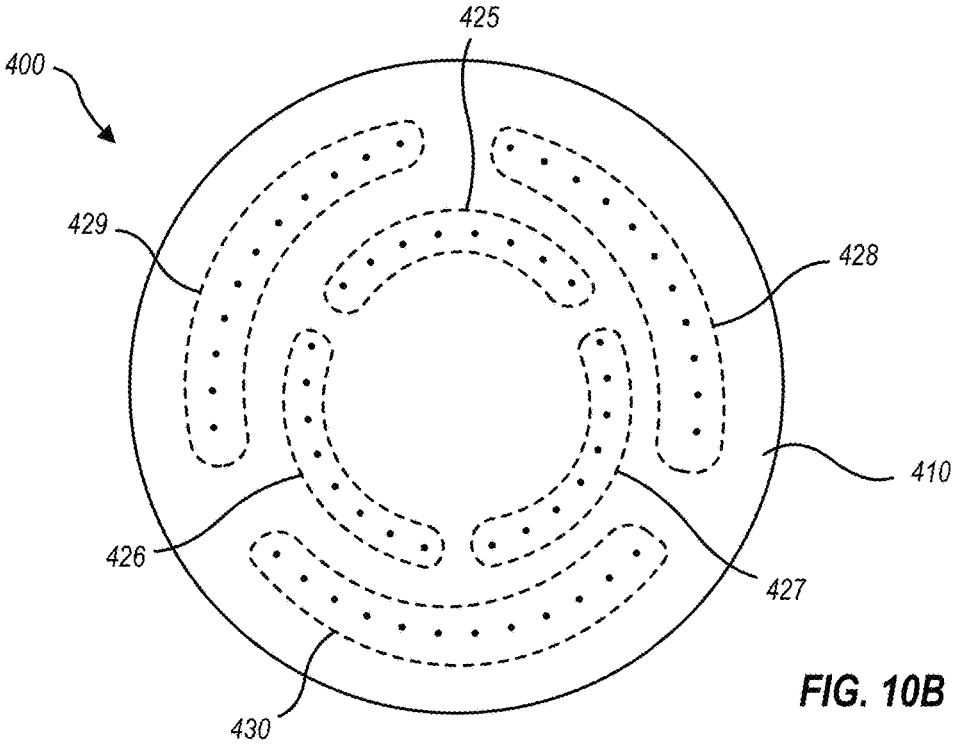

FIGS. 10A and 10B are schematic diagrams illustrating alternative layouts of LEDs for high bay light fixtures. The layouts shown in FIGS. 10A and 10B are intended to illustrate design principles and, with the accompanying explanation, will be understood by those skilled in the art to suggest many further specific design alternatives. FIG. 10A is a schematic bottom plan view illustrating a high bay light fixture 300. Light fixture 300 includes a disc-shaped base 310 and three groups of LEDs 325, 326, 327 laid out in arcs of roughly constant radius within base 310. An outer optic is not shown for clarity of illustration, but will be present when light fixture 300 is complete. Specific construction details of light fixture 300 are consistent with the details disclosed above with respect to light fixtures 100 and 200. Since LEDs 325, 326, 327 are arranged as arcs of constant radius and symmetrically about a vertical axis of disc-shaped base 310, and an outer optic will further diffuse light from LEDS 325, 326, 327, a far field photometric distribution from light fixture 300 will be circularly symmetric and can be made substantially identical to that of an HID light fixture.

Similarly, FIG. 10B is a schematic bottom plan view illustrating a high bay light fixture 400. Light fixture 400 includes a disc-shaped base 410 and six groups of LEDs 425, 426, 427, 428, 429, 430 laid out in two sets of arcs of roughly constant radius within base 410. LEDs 425, 426, 427 are laid out as arcs along an inner circle; LEDs 428, 429, 430 are laid out as arcs on an outer circle, that are offset by 60 degrees with respect to the arcs of LEDs 425, 426, 427. An outer optic is not shown for clarity of illustration, but will be present when light fixture 400 is complete. Specific construction details of light fixture 400 are consistent with the details disclosed above with respect to light fixtures 100 and 200. Since LEDs 425, 426, 427, 428, 429, 430 are arranged as arcs of constant radius and symmetrically about a vertical axis of disc-shaped base 410, and an outer optic will further diffuse light from LEDS 425, 426, 427, 428, 429, 430, a far field photometric distribution from light fixture 400 will be circularly symmetric and can be made substantially identical to that of an HID light fixture.

It is contemplated that symmetric arcs of various configurations can be utilized to generate circularly symmetric light distributions. FIGS. 4, 5 and 8 illustrate division of a circular layout into quadrants; FIGS. 10A and 10B illustrate division of a circular layout into thirds; FIG. 10B further illustrates layout of arcs into inner and outer circles. One skilled in the art will recognize that a circle may be similarly divided into two, five, six, seven, eight or more arcs, and that such arcs may be arranged along one, two, three, four or more concentric circles, to facilitate economy of manufacturing while providing a circularly symmetric far field photometric distribution. That is, multiple subsets of groups of LEDs may be arranged along arcs of differing radii relative to the vertical axis. Similarly, it is contemplated that the base itself being "disc-shaped" does not preclude related shapes such as an ellipsoidal base; arcs of LEDs may be symmetrically arranged so that a resulting light distribution remains circularly symmetric even when the base they are mounted on is not circular. Similarly, terms such as "symmetry" and "symmetric" are not limited to bilaterally symmetric arrangements such as those shown in FIGS. 1B, 4, 7 and 8; arrangements such as those shown in FIGS. 10A and 10B are also considered to be "symmetric" because they feature similarly sized arcs of LEDs spaced from one another at similar intervals about a complete circle (or two circles, as shown in FIG. 10B).

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. A high bay light fixture, comprising:

a. a substantially disc-shaped base, the base being disposed horizontally so as to define an upper surface, a lower surface and a vertical axis extending through a centroid of the base;

b. one or more planar printed circuit boards (PCBs) coupled with the lower surface of the base;

c. a plurality of groups of first LEDs, each group of the first LEDs including a plurality of the first LEDs, the plurality of groups being coupled with the one or more planar PCBs, the LEDs within each group of the first LEDs being arranged along one or more arcs of substantially constant radius relative to the vertical axis, the arcs being arranged symmetrically with respect to the vertical axis;

d. at least one lower optic coupled with the lower surface of the base such that the lower surface of the base and the at least one lower optic enclose the groups of the first LEDs;

e. a plurality of arc shaped reflectors corresponding in number to the plurality of groups of the first LEDs, wherein each of the arc shaped reflectors couples with one of the one or more planar PCBs; such that each of the arc shaped reflectors surrounds a corresponding one of the groups of the first LEDs in the plane of the one of the one or more planar PCBs with which the arc shaped reflector couples, and the lower surface of the base and the lower optic enclose the groups of the first LEDs and the arc shaped reflectors, wherein the one or more planar PCBs are a plurality of the planar PCBs that correspond in number to the plurality of groups of first LEDs and to the plurality of arc shaped reflectors, such that each group of the first LEDs and the corresponding one of the arc shaped reflectors couples with a separate, respective one of the planar PCBs f. a plurality of second LEDs coupled with the upper surface of the base;

g. a plurality of upper optics coupled with the upper surface of the base, such that the upper surface of the base and each of the upper optics enclose at least one of the second LEDs; and h. an electronics box including power supplies that convert external AC power to low voltage power for operating the first and second LEDs, the electronics box being disposed adjacent to the upper surface of the base and extending along the vertical axis therefrom.

2. The high bay light fixture of claim 1, wherein the plurality of groups of first LEDs consists of four groups of the first LEDs, the plurality of arc shaped reflectors consists of four arc shaped reflectors, and each of the one or more arcs subtends an angle of about seventy degrees about the vertical axis.

3. The high bay light fixture of claim 2, wherein the one or more planar PCBs consist of four of the planar PCBs, and wherein one respective group of the first LEDs and a respective one of the arc shaped reflectors couples with each of the planar PCBs.

4. The high bay light fixture of claim 2, wherein:

the plurality of second LEDs consists of four groups of the second LEDs;

the plurality of upper optics consists of four upper optics, each of the four upper optics and the upper surface enclosing one of the four groups of the second LEDs; and centroids of each of the four groups of the first LEDs and of the second LEDs are azimuthally offset by about forty-five degrees.

5. The high bay light fixture of claim 1, wherein the plurality of groups of first LEDs consists of three, five or six groups of the first LEDs.

6. The high bay light fixture of claim 1, wherein:

the plurality of groups of first LEDs comprises at least four groups of the first LEDs, first subsets of each of the at least four groups of the first LEDs are arranged along arcs of a first radius relative to the vertical axis, second subsets of each of the at least four groups of the first LEDs are arranged along arcs of a second radius relative to the vertical axis, and the second radius is different from the first radius.

7. The high bay light fixture of claim 1, wherein:

the plurality of second LEDs comprises four groups of the second LEDs;

the plurality of upper optics comprises four upper optics, each of the four upper optics and the upper surface enclosing one of the four groups of the second LEDs, adjacent ones of the four upper optics being configured with respective gaps therebetween; and the electronics box comprises four rectilinear sides and is oriented such that each of the four rectilinear sides faces one of the gaps between adjacent ones of the four upper optics.

8. The high bay light fixture of claim 1, wherein the upper surface of the base forms an upward protrusion, the electronics box being coupled with the upper surface atop the protrusion.

9. The high bay light fixture of claim 1, wherein the upper surface of the base forms a protrusion that extends upward and above a level of the upper optics, the electronics box being coupled with the upper surface atop the protrusion and extending upward.

10. The high bay light fixture of claim 1, further comprising spiral arms integrally formed with the disc-shaped base along an outer circumference thereof, to encourage thermal dissipation.

11. The high bay light fixture of claim 10, further comprising an outer band integrally formed with the spiral arms such that airflow apertures are defined by the base, the spiral arms and the outer band.

12. The high bay light fixture of claim 1, wherein the at least one lower optic consists of a single lower optic.

13. The high bay light fixture of claim 1, wherein each of the arc shaped reflectors reflects at least a portion of light emitted in an original direction from one of the groups of the first LEDs into a reflected direction that is nearer a direction of the vertical axis than the original direction.

14. The high bay light fixture of claim 13, wherein the original direction is substantially horizontal, and the reflected direction is downward.

15. The high bay light fixture of claim 1, wherein each of the groups of first LEDs comprises at least eight of the first LEDs.

16. The high bay light fixture of claim 15, wherein:

each of the first LEDs of at least a first one of the groups of the first LEDs couples with a respective one of the one or more planar PCBs that provides power to the first LEDs of the first one of the groups;

at least one of the arc shaped reflectors that corresponds to the first one of the groups of the first LEDs comprises:

a proximal arc arranged at a constant first radius from the vertical axis at the plane of the respective one of the planar PCBs for the given one of the groups; and a distal arc arranged at a constant second radius from the vertical axis at the plane of the respective one of the planar PCBs for the given one of the groups; and an upper surface of each of the proximal and distal arcs mounts substantially flush with the respective one of the PCBs, leaving a gap between the proximal and distal arcs, wherein the first LEDs couple with the respective one of the PCBs within the gap between the proximal and distal arcs.

17. The high bay light fixture of claim 15, wherein:

each of the groups of first LEDs comprises at least twenty of the first LEDs;

a first half of the first LEDs of each group are arranged in a first one of the one or more arcs; and a second half of the first LEDs of each group are arranged in a second one of the one or more arcs, the first one and the second one of the arcs being characterized by different radii relative to the vertical axis.

18. The high bay light fixture of claim 17, wherein the number of the groups of the first LEDs is four, and the number of the planar PCBs is four; and each of the groups of the first LEDs is coupled with a respective one of the planar PCBs in a different quadrant of the base than others of the groups of the first LEDs.

19. The high bay light fixture of claim 1, wherein each of the arc shaped reflectors substantially extends from the plane of the one of the one or more planar PCBs with which the arc shaped reflector couples, for a uniform distance.

20. The high bay light fixture of claim 1, wherein the substantially disc-shaped base comprises a substantially disc-shaped, monolithic base.

* * * * *